US008881652B2

(12) United States Patent
Middo et al.

(10) Patent No.: US 8,881,652 B2
(45) Date of Patent: Nov. 11, 2014

(54) PRINTING TEMPLATE

(76) Inventors: Jann Middo, Redondo Beach, CA (US); Hayley Mullin, Redondo Beach, CA (US)

( * ) Notice: Subject to any disclaimer, the term of this patent is extended or adjusted under 35 U.S.C. 154(b) by 758 days.

(21) Appl. No.: 12/541,115

(22) Filed: Aug. 13, 2009

(65) Prior Publication Data

US 2011/0036252 A1 Feb. 17, 2011

(51) Int. Cl.

| | |
|---|---|
| ***D06P 5/30*** | (2006.01) |
| ***B41J 17/38*** | (2006.01) |
| ***B41J 3/407*** | (2006.01) |
| ***B41J 11/06*** | (2006.01) |

(52) U.S. Cl.

CPC ..... *B41J 3/4078* (2013.01); *B41J 11/06* (2013.01)

USPC ..... 101/474; 101/41; 101/126

(58) Field of Classification Search

USPC ..... 101/474, 41, 126; 223/75, 77

IPC ..... D06P 5/30

See application file for complete search history.

(56) References Cited

U.S. PATENT DOCUMENTS

| | | | | |
|---|---|---|---|---|
| 2,927,526 | A * | 3/1960 | Parham | 101/37 |
| 2,974,838 | A * | 3/1961 | Parham | 223/76 |
| 4,619,384 | A * | 10/1986 | Chu et al. | 223/77 |
| 4,635,551 | A * | 1/1987 | Croxall | 101/470 |
| 8,177,442 | B2 * | 5/2012 | Abbott et al. | 400/48 |
| 2008/0236417 | A1 * | 10/2008 | Coffinardi et al. | 101/126 |
| 2010/0081984 | A1 * | 4/2010 | Coffinardi et al. | 602/63 |

FOREIGN PATENT DOCUMENTS

WO WO 2006011168 A1 * 2/2006

* cited by examiner

*Primary Examiner* — Leslie J Evanisko

(74) *Attorney, Agent, or Firm* — Robert J. Lauson, Esq.; Lauson & Tarver LLP

(57) ABSTRACT

A template is provided to stretch socks out slightly so the surface of the socks are smooth and flat for printing. In order to make the process cost effective, the templates are designed to print either 2 or 3 pairs of socks at one time, the template comprises: a planar registration portion configured to assist a user to align the printing template with a printer tray; and first and second receiving portions orthogonally extending from the registration portion, each receiving portion configured to receive a garment opening and having a width configured to flatten a portion of the received sock for printing, wherein the first and second receiving portions extend in opposite direction of the planar registration portion.

20 Claims, 4 Drawing Sheets

PRINTING TEMPLATE

BACKGROUND OF THE INVENTION

1. Field of the Invention

The present invention is directed toward a printing template. More particularly, some embodiments relate to a garment printing template for use with direct-to-garment digital inkjet printers.

2. Description of the Related Art

The development and advances in recent years of digital printing technology has created new opportunities in the direct-to-garment printing industry. Using inkjet, also known as ink delivery printing technology with environmentally friendly water based inks; digital apparel printing is an alternative to existing design applications including silk screening, heat transfer/sublimation, and direct embroidery. With the ability to print millions of colors 15 at one time with no color separations, no screen set ups, no cleanup, and is cost effective from a short/micro run to a more complex multicolor large run, the direct-to-garment (d-t-g) printer is a versatile tool that can be utilized in a wide variety of markets.

The garment decoration industry is big. In 2007 the total revenue for this industry was $43.9 billion in the U.S. alone. The garment decoration industry grew 6.1% in 2005 and 5.4% in 2006. Currently, direct-to-garment printing accounts for 1% of this industry, and this number is expected to jump to 10% or $12.8 billion by 2010. In a recent survey published by Impressions Magazine at the end of 2008, about 12% of decorative apparel companies who currently do both screen printing and direct embroidery also do inkjet-to-garment printing, and about 25% of these businesses plan to buy this equipment.

Apparel and soft good items currently being used in the industry include T-shirts, polo shirts, golf shirts, aprons, pillows, towels, bags, bibs, sweatshirts, hoodies, shorts, jeans, and blankets. One item that is absent from this current selection is socks. A basic apparel item, socks come in many shapes and sizes and can be knit with specific features and various needle counts. Socks are worn by everyone and range from very basic white or solid colors to colorful patterned designs. In the specialty apparel industry the only way to customize or decorate socks is through one of the following processes—silk screening, direct embroidery, heat/sublimation transfer, or knitting the pattern in. The drawback with any of these options is the set up charges, required minimums, and cost. The development of the direct-to-garment technology is a new option that can be used with socks in a cost efficient way, printing just a few pieces at a time to a larger volume order. The socks would be a new print medium for the digital apparel printing businesses, and with customized designs, the options and markets are endless. Other small apparel items such as wristbands, headbands, tights, or leg warmers could also benefit from having a template designed to be used with the apparel printer increasing the available options to print on.

SUMMARY OF THE INVENTION

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

In accordance with one or more embodiments and corresponding disclosure thereof, various aspects of printing template is described, the template comprising: a planar registration portion configured to register the printing template with a printer tray, also referred to in the art as a print table; and a first receiving portion orthogonally extending from the registration portion configured to receive a sock opening, the receiving portion having a width configured to flatten a portion of the received sock for printing.

In one embodiment, the thickness of the planar registration portion is greater than the thickness of the receiving portion. Both portions may be located on the same plane and may be substantially parallel to the main printing plane of the printer tray. The thickness of the registration portion may be selected such that printing template lies substantially parallel to a plane of the printer tray while having a sock inserted in the receiving portion. In this way, optimum printing results can be achieved.

In one embodiment, the first receiving portion also comprises at least one recess portion adapted to hold the received sock in place. The recesses portion may be a notch, an opening, or a bore on the side of the receiving portion. In this way, a portion of a sock may be snared as it wraps itself around the receiving portion. Alternatively, a protrusion may be used to secure the sock in place. The protrusion may be oriented and angled in such away that a sock may slide in easily but hard to slide back out. Whether a recess or protrusion is used, the receiving portion may have one or more of the recess or protrusion at the proximal end of the orthogonally extending receiving portion.

The printing template may have two or more receiving portions. Each portion orthogonally extends from the registration portion and is substantially parallel and co-planar to other receiving portions. The width of the receiving portion may range from 2-4.5 inches. In one embodiment, the width of the receiving portion is 3.5 inches. The length of the orthogonally extending receiving portion may range from 4-12 inches, depending on the size of the sock used.

The receiving portion may also include a visual indicator to help a user to properly position a sock into the receiving portion. For example, the visual indicator may indicate to the user which direction to position the heel of the sock. In this way, operator errors may be reduced. Additionally, the receiving portion may also have rounded edges at the distal end of the receiving portion. The rounded edges allow the sock to be fed in easily without be ensnared.

In accordance with one or more embodiments of the present invention, a printing template comprises: a planar registration portion configured to assist a user to align the printing template with a printer tray; and first and second receiving portions orthogonally extending from the registration portion, each receiving portion configured to receive a garment opening and having a width configured to flatten a portion of the received sock for printing, wherein the first and second receiving portions extend in opposite direction of the planar registration portion.

To the accomplishment of the foregoing and related ends, the one or more embodiments comprise the features hereinafter fully described and particularly pointed out in the claims. The following description and the annexed drawings set forth in detail certain illustrative aspects of the one or more embodiments. These aspects are indicative, however, of but a few of the various ways in which the principles of various embodiments may be employed and the described embodiments are intended to include all such aspects and their equivalents.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention.

DETAILED DESCRIPTION

It is difficult and labor intensive to lay out individual socks on a printer tray and print on them as they would not lay flat and consistent printing would be hard to achieve. Labor time for set up would increase the cost per pair of socks which would make the final cost to print on socks more expensive. A solution to this problem is a die-cut planar template inserted inside the individual socks. This heavy cardboard template has been designed specifically to facilitate the process of printing directly on the socks with the inkjet garment printer in a consistent and efficient manner. Although cardboard is a suitable material for making the printing template, other light and rigid materials may also be used, such as plastics, wood, and metals.

The template stretches a sock out slightly so the surface of the sock is smooth and flat, a prerequisite in printing with the digital apparel printer. In order to make the process cost effective, the templates are designed to print either 2 or 3 pairs of socks at one time, depending on the silhouette of the socks. Printing multiples of socks at one time uses the same amount of time and ink it takes to print one T-shirt, and the retail cost is comparative as well. The socks will be inserted at the knitting mill and be shipped as "print ready" blanks, reducing labor costs of inserting socks at the printer. The printer operator will have preset measurements to follow on the computer to "drop in" artwork for exact placement prior to sending the document to the printer. Once the socks are printed the ink needs to be set with a heat press, and the transition to this step is made easy by having the socks already inserted on the template. Once the ink is set, the socks are easily removed from the cardboard template and can be packaged immediately.

Figure 1:
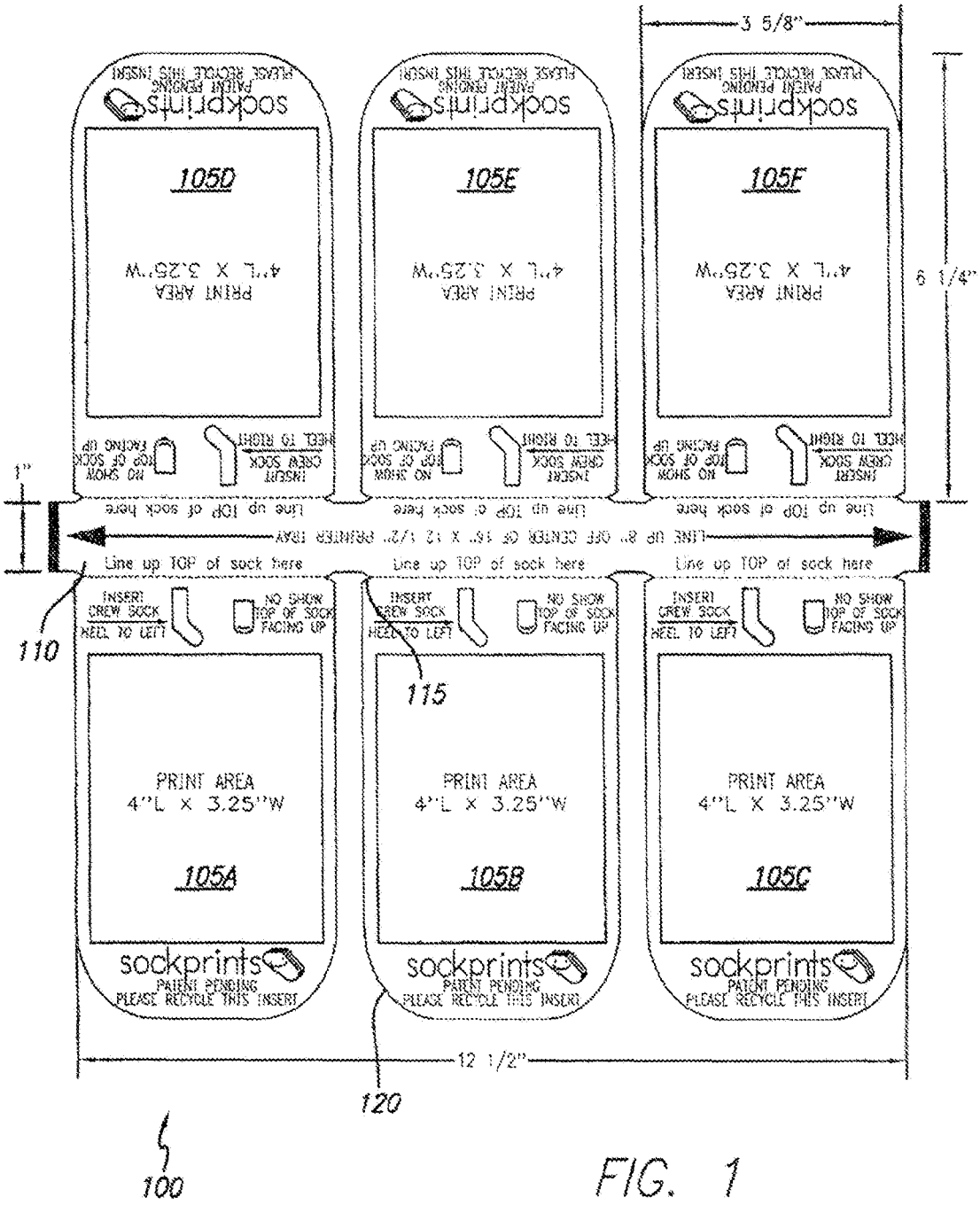
FIGS. 1-3 illustrate top views of exemplary printing templates according to one or more embodiments of the present invention.

FIG. 1 illustrates a printing template 100 according to one embodiment of the present invention. Printing template 100 may be a semi-rigid planar insert that can be used for two different types of socks—a crew length sock or a no shown sock. Printing template 100 may be made of cardboard or other suitable semi-rigid materials. As shown in FIG. 1, printing template 100 includes six planar receiving portions 105A-F, three on each side of a registration portion 110

Registration portion 110 may include textual and visual instructions on how to align and place printing template 100 onto a printer tray (not shown). For example, printing template may include the following printed instruction, "Line Up 8" Off Center of a 16"×12½" Printer Tray."

Each of receiving portions 105A-F may extend orthogonally outward from registration portion 110. Each portion may be parallel with respect to one another. Further, portions 105A-F and registration portion 110 may be co-planar. In one embodiment, registration portion 110 has a larger thickness than each of receiving portions 105A-F. The larger thickness of registration portion 110 may allow the printing template and sock assembly (i.e., template with socks inserted into the receiving portions) to lie substantially flat on the printer tray as the larger thickness of registration portion 110 may compensate for the added thickness of the sock.

Each of receiving portions 105A-F may have a recess portion or notch 115 to trap or ensnare a sock and hold it in place. Each receiving portion 105 may have two or more recess portions. Each receiving portion 105 may have at least one recess one each side of the receiving portion. Further, each receiving portion 105 may have rounded edges 120 to help guide a sock (not shown) into position. Rounded edges 120 may reduce the chances of a sock being stuck as it is being fed into the receiving portion.

In template 100, three pairs of socks can be printed at one time. As mentioned, inserting and printing instructions may be printed on the planar insert or receiving portion. Guides may be printed on template 100 for consistent placement on the print tray. Crew length socks may have the images printed on outside sock of each pair, one for the left foot and one for the right. A diagram of the crew socks may also be printed on template 100 to indicate the direction socks should be facing when inserted. The no show sock may have the image printed on the top of the sock, when worn the image will be seen on the top of the foot. A diagram of the no show sock may also be printed on the insert to show the top of the sock facing up. Notches are cut out at the top of each sock insert to help secure the socks stay in place when inserting, shipping, and printing on the socks. The print image area for either sock silhouette may have a dimension of 4"L×3.25"W.

In one embodiment, registration portion 110 has a width of one inch. The width and length of each receiving portion may be 3⅝ inches and 6¼ inches, respectively. In addition, template 100 may have a width of 12½ inches and a length of 14 inches. Although specific dimensions are described, the dimensions of template 100 may be adjusted for various sizes of sock or even for other types of garment or apparel, such as gloves, wristbands, headbands, tights, and leg warmers. The dimensions of template 100 may also be adjusted to fit various printer trays.

Figure 2:
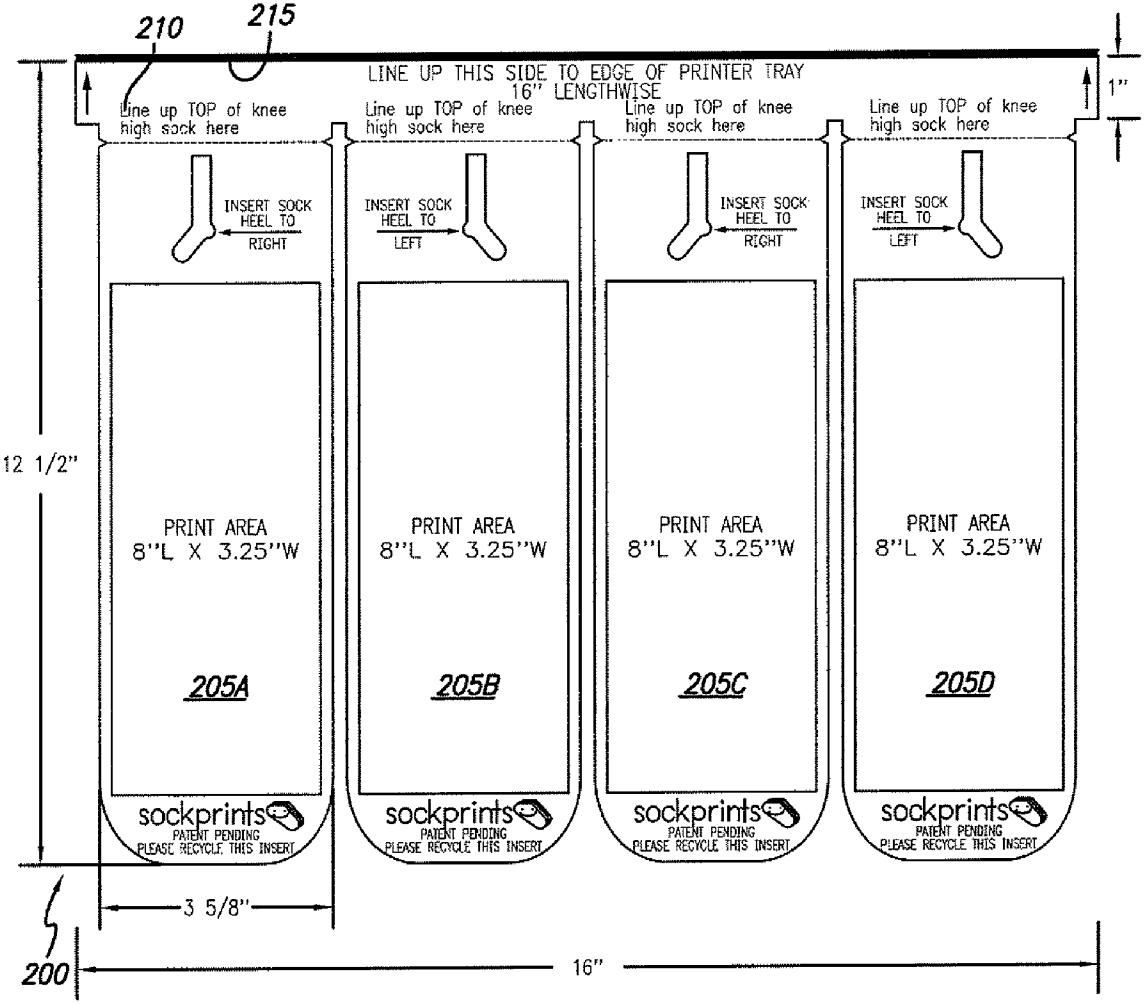

FIG. 2 illustrates a template 200 according to on embodiment of the present invention. Template 200 may incorporate one or more features of template 100 as described above. Template 200 may be used with a straight up, flat knit knee high sock. In the configuration shown, two pairs of socks can be printed at one time, and inserting and printing instructions are printed on the planar insert. Knee high socks may have images printed on the outside sock of each pair, one for the left foot and one for the right. A diagram of the knee high sock may be printed on the insert to indicate the direction of the heel for the left and right sock (per pair). Similar to template 100, notches may be cut out at the top of each sock insert to help secure the socks in place when inserting, shipping, and printing on the socks. The print area for this sock silhouette may have a dimension of 8"L×3.25"W.

In one embodiment, each of receiving portions 205A-D of template 200 may have a width of 3⅝ inches and a length of 11½ inches. As shown in FIG. 2, template 200 also includes a registration portion 210 that includes a top straight edge 215. During operation, the operator may use edge 215 to align template 200 to the printer tray. In this way, consistent printing results may be achieved. Although specific dimensions are described, the dimensions of template 200 may be adjusted for various sizes of sock, garment types, and printer tray sizes.

Figure 3:
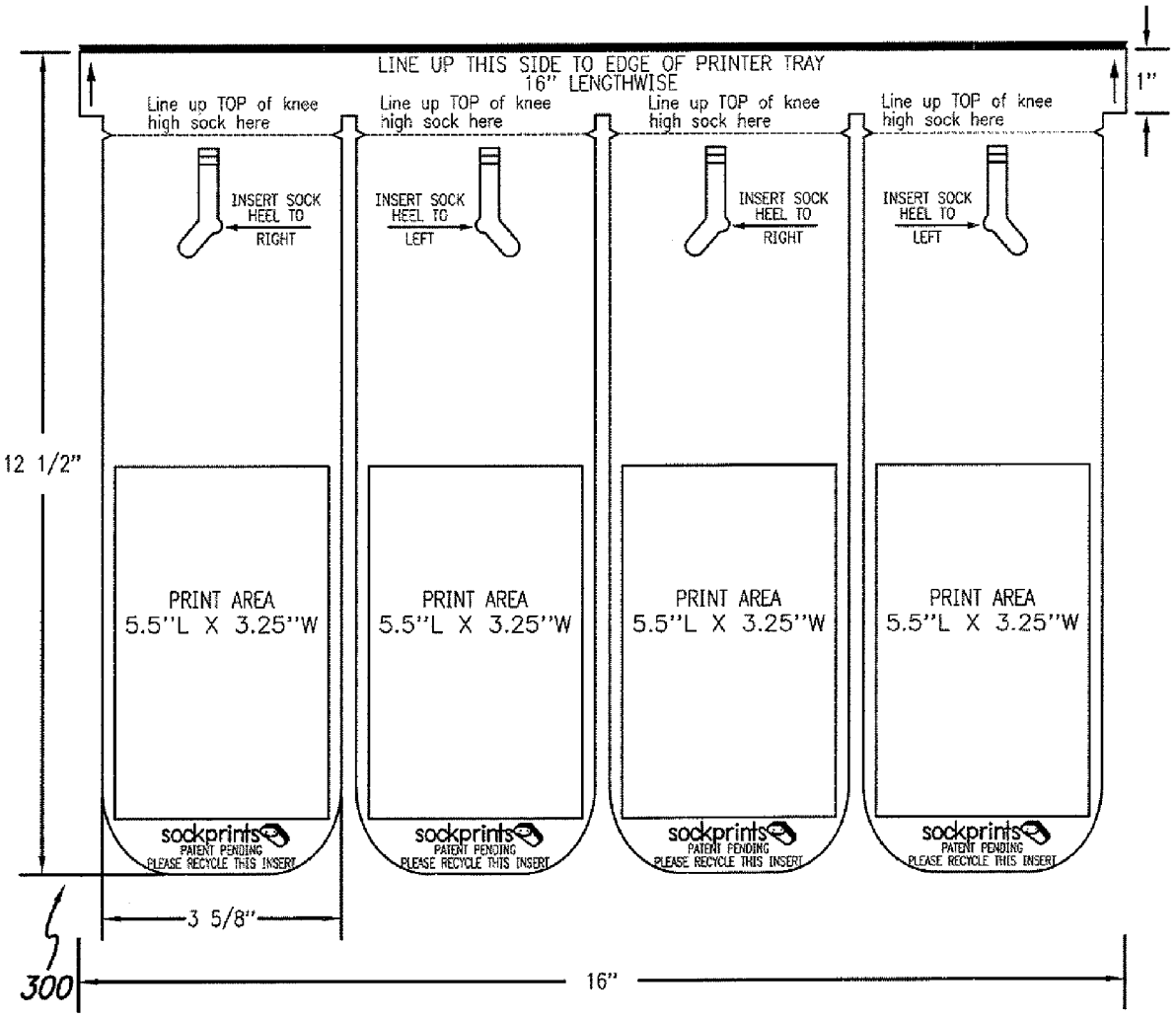

FIG. 3 illustrates a template 300 according to one embodiment of the present invention. Template 300 may be used with a sport knee high sock. Template 300 may incorporate one or more features of template 100 or 200 as described above. In template 300, two pairs of socks can be printed at one time. Inserting and printing instructions may be printed on the surface of the planar insert or receiving portion. Knee high socks may have images printed on outside sock of each pair, one for the left foot and one for the right. A diagram of the knee high sock may be printed on the receiving portion to indicate the direction of the heel for the left and right sock (per pair). Notches may be cut out at the top of each sock insert to help secure the socks in place when inserting, shipping, and printing on the socks. The print area for this sock silhouette may have a dimension of 5.5"L×3.25"W.

Figure 4A:
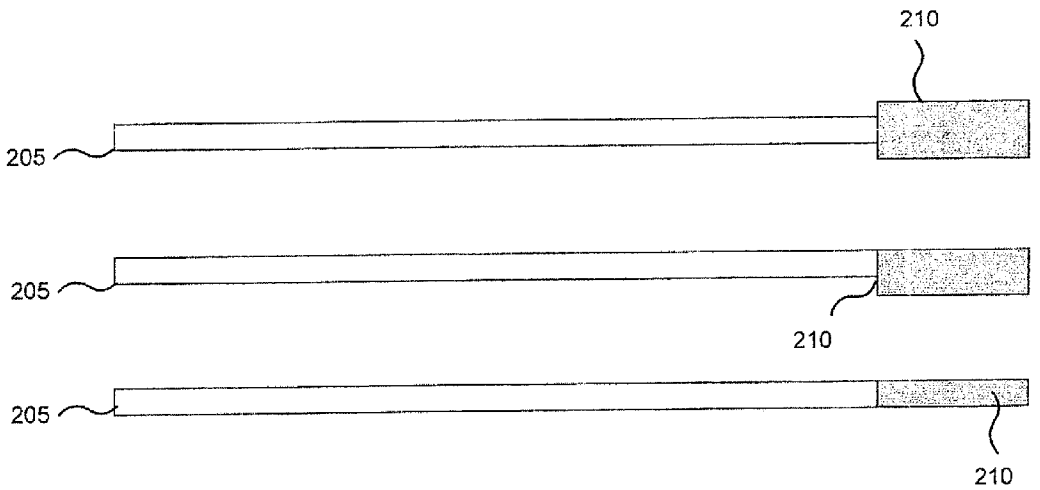
FIGS. 4A and 4B illustrate side views of exemplary printing templates according to one or more embodiments of the present invention.
Figure 4B:
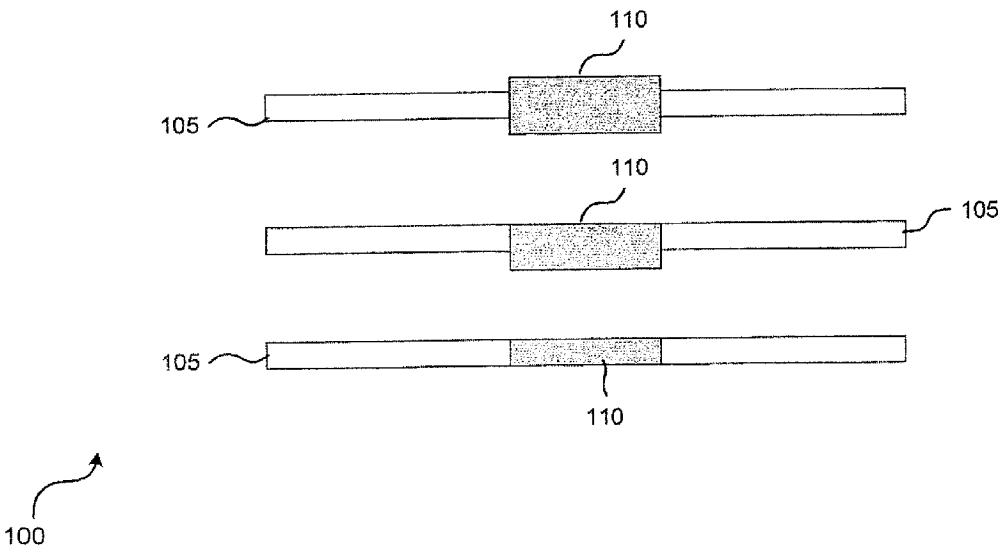

FIGS. 4A-B illustrate side views of templates 100-300 according to one or more embodiments of the present invention. As shown in FIG. 4A, registration portion 210 may have different thickness than receiving portion 205. In one embodiment, registration portion 210 has a thicker thickness and protrudes beyond both bottom and top planes of receiving portion 205. Alternatively, registration portion 210 may be flushed with only one plane of receiving portion 205 but protrude beyond the second plane. In yet another embodiment, registration portion 210 may be flushed with both planes of receiving portion 205.

FIG. 4B illustrates the side view of template 100. Similar to registration portion 210, registration portion 110 may be flushed on both upper and lower planes or flushed on only one plane with respect to the upper and lower planes of receiving portion 105. In one embodiment, registration 110 and receiving portion 105 have the same thickness.

While various embodiments of the present invention have been described above, it should be understood that they have been presented by way of example only, and not limitation. It will be apparent to persons skilled in the relevant art that various changes in form and detail can be made therein without departing from the spirit and scope of the present invention. Thus, the breadth and scope of the present invention should not be limited by any of the above-described exemplary embodiments, but should be defined only in accordance with the following claims and their equivalents.

What is claimed is:

1. A planar, die-cut sock printing template comprising:

a planar registration portion configured to register the sock printing template with a direct-to-garment ink delivery system print tray;

a set of planar receiving portions extending from opposite sides of the registration portion, said receiving portions each configured to engage a sock opening of a sock, the receiving portions each having a width configured to stretch and flatten a portion of the sock for printing, wherein the registration portion has a first planar thickness and the receiving portions have a second planar thickness, and wherein the first planar thickness is greater than the second planar thickness;

the sock printing template defining a semi-rigid planar insert structure integrally formed and discretely configured apart from the direct-to-garment ink delivery system print tray, wherein the sock printing template and socks received thereon form a composite print-ready blank processed by the direct-to-garment ink delivery system.

2. The sock printing template of claim 1, wherein the first planar thickness is selected such that the sock printing template lies substantially parallel to a plane of the print tray while having a sock inserted on at least one of the receiving portions.

3. The sock printing template of claim 1, wherein each of the receiving portions further comprises at least one recess portion adapted to hold the received sock in place.

4. The sock printing template of claim 3, wherein the at least one recess portion is located at an end of the receiving portion proximal to the registration portion.

5. The sock printing template of claim 1 each receiving portion orthogonally extends from the registration portion, the receiving portions being substantially parallel and co-planar one relative to the other.

6. The sock printing template of claim 1, wherein the width of each of the receiving portions ranges from 2-4.5 inches.

7. The sock printing template of claim 1, wherein the width of each of the receiving portions is 3.5 inches.

8. The sock printing template of claim 1, wherein each of the receiving portions ranges from 4-12 inches in length.

9. The sock printing template of claim 1, wherein each of the receiving portions further comprises a visual indicator to guide proper positioning of a sock onto the receiving portion.

10. The sock printing template of claim 1, wherein each of the receiving portions further comprises a rounded edge at a distal end of the receiving portion.

11. A planar printing template comprising:

a planar registration portion configured to align the printing template to an ink delivery system print tray; said registration portion disposed between planar first and second receiving portions extending from the registration portion, each receiving portion configured to engage a garment opening and having a width configured to stretch and flatten a portion of the garment for printing;

wherein the first and second receiving portions extend in opposite directions from the registration portion, and wherein the registration portion has a greater thickness than the first and second receiving portions;

the printing template defining a semi-rigid planar insert structure integrally formed and discretely configured apart from the ink delivery system print tray, wherein the printing template and garments received thereon form a composite print-ready blank processed by the ink delivery system.

12. The printing template of claim 11, wherein the registration portion thickness is selected such that the printing template lies substantially parallel to a plane of the print tray while having a garment engaged by one of the first and second receiving portions.

13. The printing template of claim 11, wherein the first receiving portion further comprises at least one recess portion adapted to hold the garment in place.

14. The printing template of claim 13, wherein the at least one recess portion is located at a proximal end of at least one of the receiving portions.

15. The printing template of claim 11, wherein the first and second receiving portions are co-planar and parallel to a major plane of the registration portion.

16. The printing template of claim 11, wherein the width of each of the receiving portions ranges from 2-4.5 inches.

17. The printing template of claim 11, wherein the width of each of the receiving portions is 3.5 inches.

18. The printing template of claim 11, wherein the first receiving portion ranges from 4-12 inches in length.

19. The printing template of claim 11, wherein the first receiving portion further comprises a visual indicator to guide proper positioning of a garment onto the first receiving portion.

20. The printing template of claim 11, wherein the first receiving portion further comprises a rounded edge at a distal end of the first receiving portion.

* * * * *